United States Patent [19]

Pallan

[11] 4,099,275

[45] Jul. 11, 1978

[54] CHAIR CONVERTIBLE INTO A BED

[76] Inventor: Erwin Pallan, Dietlindestr. 2, Pöchlarn, Austria, 3380

[21] Appl. No.: 757,221

[22] Filed: Jan. 6, 1977

[30] Foreign Application Priority Data

Jan. 12, 1976 [AT] Austria ..... 157/76

[51] Int. Cl.[2] ..... A47C 17/16

[52] U.S. Cl. ..... 5/18 R; 5/46 R

[58] Field of Search ..... 5/12, 17, 18, 28, 29, 5/37, 43–46

[56] References Cited

U.S. PATENT DOCUMENTS

| | | | |
|---|---|---|---|
| 2,250,148 | 7/1941 | Bonnet et al. | 5/18 R |
| 3,088,130 | 5/1963 | Walstad | 5/46 |
| 3,422,467 | 1/1969 | Wiberg | 5/44 R |
| 3,656,189 | 4/1977 | Wiberg | 5/45 |

FOREIGN PATENT DOCUMENTS

| | | | |
|---|---|---|---|
| 1,514,677 | 2/1968 | France | 5/44 R |

*Primary Examiner*—Casmir A. Nunberg
*Attorney, Agent, or Firm*—Karl F. Ross

[57] ABSTRACT

A chair convertible into a bed, comprising a stationary frame having a seat member positioned therein and displaceable therefrom to extend in a forward direction and a support member positioned in the frame below the seat member and displaceable thereby to extend in a forward direction. A back-rest is hinged to the seat member and is adapted to move therewith from an upright position in the frame into a substantially horizontal position beyond the frame in a forward direction, coming to rest coplanar between the seat member and a reclining surface which becomes exposed when the back-rest and seat member are extended.

5 Claims, 3 Drawing Figures

Figures 1, 3:
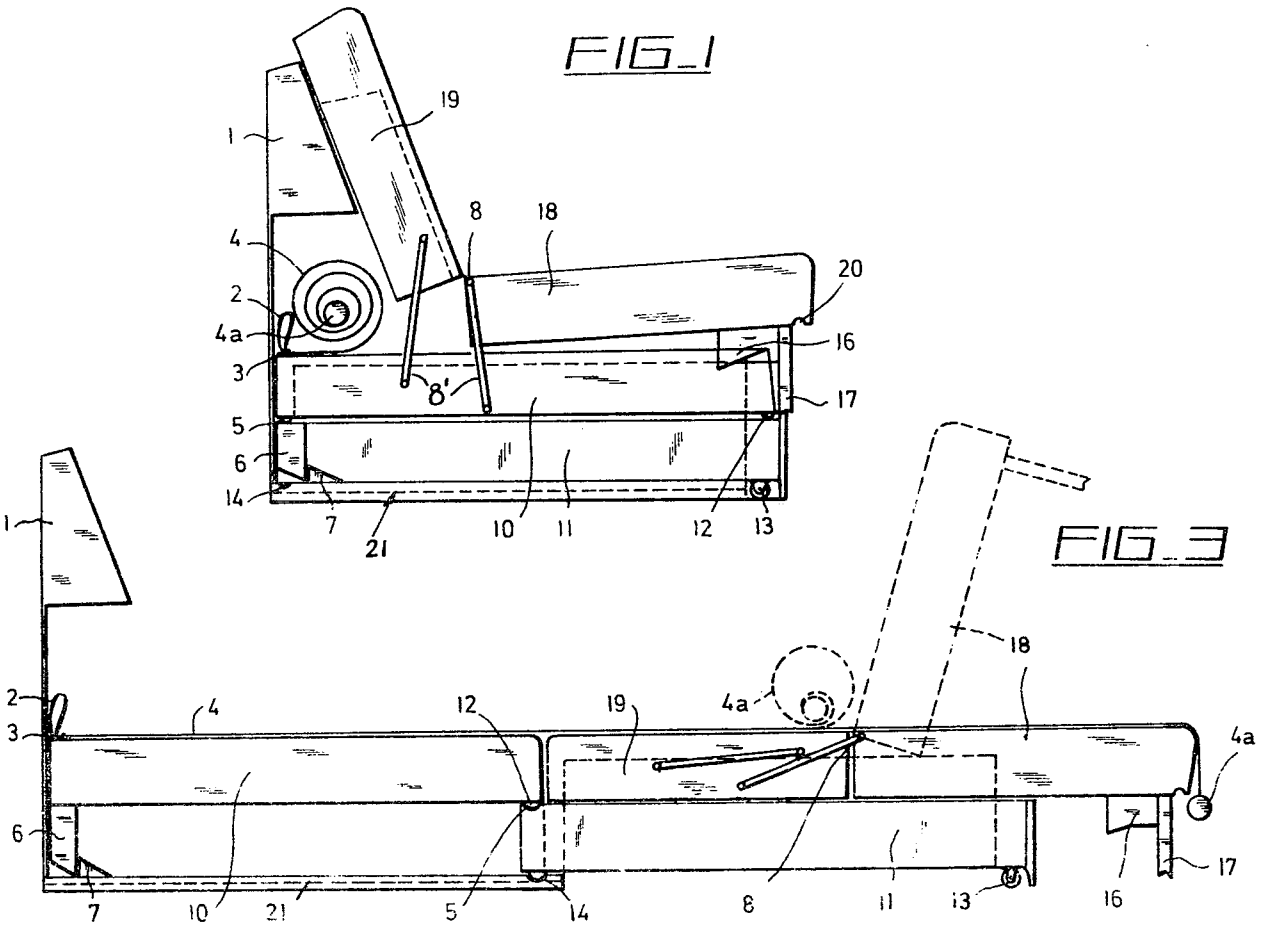

1
2
3
4
4a
5
6
7
8
8'
10
11
12
13
14
16
17
18
19
20
21

CHAIR CONVERTIBLE INTO A BED

FIELD OF THE INVENTION

The invention relates to a chair of the type which is convertible into a bed.

BACKGROUND OF THE INVENTION

Convertible furniture of this kind, in the form of a bench covertible into a double bed, is already known. This unit is designed to extend at right angles to its length. When the unit is used as a bench, the two cushions for the reclining surface lie one above the other, a carriage being provided which is adapted to be displaced transversely and is guided in the stationary frame. The unit also comprises a bedding drawer which is arranged within the carriage, which can move independently, and to which the back-rest, adapted to be folded down in order to extend the reclining surface, is hinged. The movement of the backrest is controlled by sloping guides in the arm-rests. Also known are convertibles in which crossed links are provided for the purpose of folding over the back-rest in such a manner that it cannot come into contact with the wall behind it or with another piece of furniture.

The disadvantages of these convetibles is that when the bed configuration is required, the chair cushions arranged one above the other must be opened out, with the sloping guides tending to jam.

OBJECT OF THE INVENTION

It is therefore an object of the present invention to eliminate the above mentioned disadvantages.

SUMMARY OF THE INVENTION

In the case of convertible furniture of the kind mentioned above, this object is achieved in that a seat member is hinged both to a support member and to a back-rest, with a stationary frame provided with a reclining surface, so that with the unit in use as a bed, the back-rest is arranged between the reclining surface and the seat member, whereas with the unit in use as a chair, the seat member lies above the reclining surface.

According to a further feature of the invention, the seat member and the back-rest may each be connected to the support member by means of a pair of links, and to each other by means of a hinge. The hinge may be fitted with (releasable) locking means.

BRIED DESCRIPTION OF THE DRAWING

Figure 2:
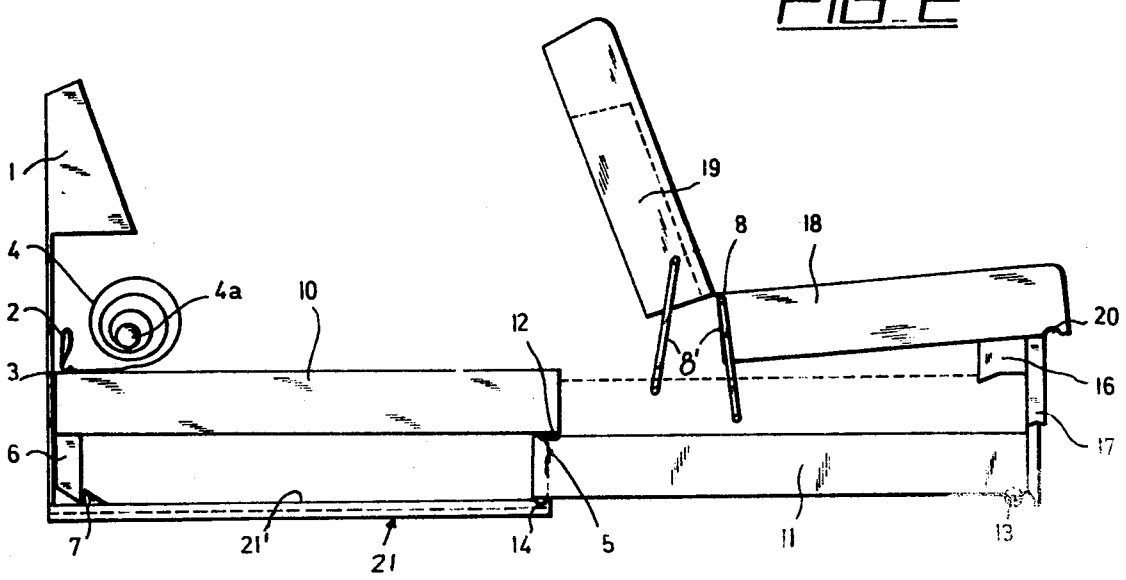

The invention is explained hereinafter in greater detail in conjunction with the preferred embodiment illustrated diagrammatically in the drawing attached hereto, wherein:

FIG. 1 shows the chair in cross section;
FIG. 2 shows the unit partly extended; and
FIG. 3 shows the bed in cross section.

SPECIFIC DESCRIPTION

The convertible comprises a stationary frame 21 provided with a rear wall having a back-rest stop 1 attached thereto for the purpose of supporting a back-rest 19. A support member 11, adapted to be extended in the forward direction i.e. away from back-rest stop 1, is guided on the side of frame 21 by means of runners 21', formed thereon and engaged by back rollers 14 provided on member 11. Above the support member 11, a reclining surface 10 is arranged stationarily in frame 21 and is provided with rollers with 12, which co-operate as stops with rollers 5 provided on the support member 11. However, reclining surface 10 is not rigidly connected to frame 21; instead, this part is merely held by a detent 6 engaged by a wedge 7. Thus when it is deisred to transport or clean the unit, reclining surface 10 may be removed or, after the rear end thereof has been raised by means of loop 2, it may be pushed forward.

Hinged to each side of central part 11 is a pair of links 8 supporting, on the one hand, a seat member 18 and, on the other hand a back-rest 19; these two components are hinged together, preferably by means of hinge 8 fitted with a releasable locking means (not shown.) The front of seat member 18 is fitted with a member 17 serving to support it on support member 11 when the unit is used as a chair, or on the floor, when the unit is in use as a bed. Lateral stops 16 are provided to ensure that seat member 18 cannot be inadvertently displaced. Finally, seat member 18 is provided with a grip 20.

It is furthermore desirable to provide, for the bed configuration, a protective cover 4 which is secured to reclaining surface 10 by means of snap fasteners 3 and which can be extended by means of a rod 4a, or the like, whereas when it is not in use, it may be stowed behind back-rest 19, The chair shown in FIG. 1 is converted into the bed shown in FIG. 3 as follows.

Seat member 18 is held by grip 20 and is extended in the forward direction, overcoming any means that may be provided to prevent the seat member from extending inadvertently. Seat member 18, which rests upon support member 11, draws the member 11 along. The member 11 slides, on the bottom, on rollers 13 which side on the floor, and 14 engaging runners 21' and on the top by rollers 5 and 12. The extension of the support member is completed as soon as runners 5 engage runners 12 (FIG. 2).

Continued pulling on grip 20 causes seat member 18 to pivot upwardly, carrying along back-rest 19, the latter being thus folded down into a horizontal position, level with surface 10. Further forward movement of seat member 18 causes it also to sink to the level of reclining surface 10 located in frame 21. In the bed configuration, leg 17 of seat member 18 rests upon the floor. Hinge 8 ensures that back-rest 19 is positioned between the seat member 18 and the reclining surface 10.

With the unit in this configuration, seat member 18 can be raised to the position shown in FIG. 3 in dotted lines, thus providing access to the interior of support member 11, in which bed-linen may be stowed. Known hinges 8 are provided with releasable locking means which make it possible to hold seat member 18 in the upwardly-pivoted position. Pivoting the seat member further releases this lock and allows the seat member to be folded down.

Finally, protective cover 4 is rolled out and stretched taut by means of rod 4a.

The bed according to FIG. 3 may be converted back into the chair shown in FIG. 1 by reversing this sequence of operations. After protective cover 4 has been removed and the bed-linen has been stored in support member 11, with seat member 18 pivoted upwardly for this purpose, the seat member is pressed down, whereby back rest 19 is returned to the sitting position (FIG. 2) with the aid of hinge 8 which is now locked. Seat member 18 and support member 11 are then returned to the position shown in FIG. 1, with back-rest 19 supported against stop 1.

The invention thus provides a chair which may easily and simply be converted into a bed, and may be similarly be converted back into a chair. The chair is compact and takes up little room. It may easily be taken apart, which is an advantage for transporting and repairing. It also has ample room for stowing bed-linen.

I claim:

1. A chair convertible into a bed, comprising:

a stationary frame having an upright portion provided with a backrest stop;

a seat member positioned on said frame and displaceable relative thereto to extend in a forward direction;

a support member positioned in said frame below said seat member for the support thereof and displaceable thereby to extend in said forward direction, said seat member being connected to said support member;

a body defining a bed-forming surface positioned in said frame below said seat member and above said support member when said members do not extend in said forward direction;

a backrest hinged to said seat member and leaning on said stop in an upright position of the backrest, said backrest being displaceable by said seat member to assume a horizontal position between said body and said seat member on a level therewith, said backrest being pivotally connected to said support member in all positions; and means in said frame for guiding said members for the displacement thereof.

2. A chair as defined in claim 1, further comprising a protective cover positioned within said frame in a stored condition and extendible therefrom in said forward direction to cover said surface, said backrest and said seat member in the extended position of the latter.

3. A chair as defined in claim 1, further comprising:

a first link pivotally connected to said backrest and said support member for the movable support of said backrest;

a second link pivotally connected to said seat member and said support member for the movable support of said seat member; and said backrest is hinged to said seat member by a hinge provided with releasable locking means for maintaining the angle between said backrest and said seat member during the displacement thereof.

4. A chair as defined in claim 1 wherein the guide means comprises:

runners formed on said frame and extending in said forward direction;

first rollers provided on said support member and engaging said runners;

second rollers provided on said support member and riding on the floor; and means for stopping said support member at a predetermined extension thereof.

5. A chair as defined in claim 3, further comprising:

a leg rigid with said seat member for resting on said support member in an unextended position thereof and for resting on the floor in an extended position of said seat member; and a storage space provided in said support member and accessible in an extended position thereof by pivoting said seat member into an upright position.

* * * * *